US009505588B2

(12) United States Patent
Guillot et al.

(10) Patent No.: US 9,505,588 B2
(45) Date of Patent: Nov. 29, 2016

(54) RETRACTABLE STOP FOR LOW OVERHEAD ELEVATORS

(75) Inventors: Nicolas Guillot, Coullons (FR); Aurelien Fauconnet, Isdes (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 662 days.

(21) Appl. No.: 13/635,772

(22) PCT Filed: Apr. 12, 2010

(86) PCT No.: PCT/IB2010/001056

§ 371 (c)(1),
(2), (4) Date: Sep. 18, 2012

(87) PCT Pub. No.: WO2011/128718

PCT Pub. Date: Oct. 20, 2011

(65) Prior Publication Data

US 2013/0025975 A1 Jan. 31, 2013

(51) Int. Cl.

| | |
|---|---|
| ***B66B 5/28*** | (2006.01) |
| ***B66B 7/02*** | (2006.01) |
| ***B66B 5/00*** | (2006.01) |

(52) U.S. Cl.

CPC ..... *B66B 7/027* (2013.01); *B66B 5/0056* (2013.01)

(58) Field of Classification Search

CPC .... B66B 5/005; B66B 5/0056; B66B 5/0068
USPC ..... 187/414, 357, 343, 356, 360
See application file for complete search history.

(56) References Cited

U.S. PATENT DOCUMENTS

| | | | | |
|---|---|---|---|---|
| 5,727,657 | A * | 3/1998 | Foelix | 187/356 |
| 5,806,633 | A * | 9/1998 | Macuga | 187/357 |
| 6,481,534 | B1 * | 11/2002 | Malone, Jr. | 187/377 |
| 6,736,242 | B2 * | 5/2004 | Nygren | 187/357 |
| 7,077,243 | B2 * | 7/2006 | Huber et al. | 187/357 |
| 7,249,656 | B2 * | 7/2007 | Huber et al. | 187/343 |
| 7,322,445 | B2 * | 1/2008 | Kocher et al. | 187/362 |
| 7,650,969 | B2 * | 1/2010 | Monzon et al. | 187/300 |
| 7,832,526 | B2 * | 11/2010 | Sirigu | 187/357 |
| 8,136,637 | B2 * | 3/2012 | Coquerelle et al. | 187/391 |

(Continued)

FOREIGN PATENT DOCUMENTS

| | | |
|---|---|---|
| EP | 0957 061 B1 | 4/2003 |
| JP | H06135685 A | 5/1994 |
| JP | 2005255294 A | 9/2005 |

(Continued)

OTHER PUBLICATIONS

International Search Report and Written Opinion for application PCT/IB2010/001056, dated Dec. 30, 2010, 8 pages.

*Primary Examiner* — Michael Riegelman
(74) *Attorney, Agent, or Firm* — Cantor Colburn LLP

(57) ABSTRACT

A retractable stop and the method of use thereof to control travel range of an elevator system are disclosed. The retractable stop may include a vertical mounting bracket, an impact plate, and a support member. The support member may include an upper end pivotably connected to a distal portion of the impact plate and a lower end movable in relation to the mounting bracket. The proximal portion of the impact plate may be pivotably connected to the mounting bracket. When the retractable stop is in a retracted position, the impact plate does not significantly contribute to the lateral profile of the retractable stop.

11 Claims, 11 Drawing Sheets

(56) References Cited

U.S. PATENT DOCUMENTS

| | | | | |
|---|---|---|---|---|
| 8,162,108 | B2 * | 4/2012 | Sirigu et al. | 187/289 |
| 2009/0183955 | A1 * | 7/2009 | Gonzalez Rodil et al. | 187/404 |

FOREIGN PATENT DOCUMENTS

| | | | |
|---|---|---|---|
| KR | 102004008576 | A | 10/2004 |
| WO | WO 2008/002300 | A1 | 1/2008 |
| WO | WO 2008/004022 | A1 | 1/2008 |

* cited by examiner

RETRACTABLE STOP FOR LOW OVERHEAD ELEVATORS

CROSS-REFERENCE TO RELATED APPLICATIONS

This application is a U.S. national stage filing under 35 USC §371 of International Patent Application No. PCT/IB2010/001056, filed on Apr. 12, 2010.

FIELD OF THE DISCLOSURE

Background

This disclosure generally relates to elevators and more particularly relates to retractable stop for controlling the travel range of an elevator system during normal or maintenance operation.

BACKGROUND OF THE DISCLOSURE

Low overhead elevators have become increasingly popular. As opposed to traditional elevators which include motors, governors, and associated cabling in a machine room at the top of vertical hoistways in which the elevators move, low overhead elevators do not require placement of such components at the top of the hoistways. For example, some low overhead elevators may provide the driving force through machines located above the elevator roof but without the provision of a machine room. In so doing, such low overhead elevators conserve valuable space in the commercial and residential buildings in which they operate.

When a service technician wants to inspect or service the pulleys, hoisting cables, guide rails, machine controls or any other device at the upper end of the hoistway, he or she usually needs to do so on top of an elevator car. The cars may be designed to slowly approach the desired locations, such as by using a control system as disclosed in a co-pending application published as WO 2008/004022. In order to maintain the safety of the technician, extra preventive measures have been developed to stop the upward movement of the car as it approaches the top of the hoistway to provide ample space for the technician. This is particularly important in the case of low overhead elevators, in which there is less clearance between the top of car and the top of the hoistway.

One of the preventative measures is a retractable stop provided at the pit floor of the elevator system to block further downward movement of a counterweight when deployed. An example of this is disclosed in another co-pending application published as WO 2008/002300. As the counterweight is operatively connected to the elevator car, stopping downward movement of the counterweight necessarily stops upward movement of the car. When the elevator operates under normal mode, the stop is retracted to allow the counterweight to downwardly extend to its full range.

When deployed, a triangular support structure is formed among a horizontal strike plate, an oblique stop member and a vertical mounting channel, in which the horizontal impact plate blocks the downward movement of the counterweight with the impact force transmitted into the pit floor through the mounting channel and support member. However, the triangular configuration necessarily requires the support member to bear some horizontal vector of the impact force. As a result, the support member has to be constructed with sufficient lateral dimension and heft to provide the needed structural rigidity.

Meanwhile, the dimensions and location of the elevator car and counterweight are restricted by the limited space within the hoistway. In order to maintain safe operation of the elevator car in its full range, a minimum clearance (e.g. 25 mm) is required between the fully retracted stop and counterweight to accommodate any incidental horizontal movement of the counterweight within the hoistway. However, because of its relatively thick lateral profile necessary to maintain adequate structural rigidity, the existing stop may fail to meet the minimum clearance requirement. One solution is to create a longitudinal groove on the surface of the counterweight (including the counterweight frame and counterweight filler) that faces the retractable stop to provide the extra clearance. While effective, this necessarily requires modification of the existing elevator system or creation of a specifically configured counterweight, either of which adds significant expense to the design.

Hence, there is a need for a retractable stop with an improved lateral profile that meets the minimum clearance requirement when used with a conventional counterweight without imparting significant additional cost. Moreover, there is a need for a retractable stop that has an improved lateral profile in a retracted position without sacrificing the load bearing capacity in a deployed position.

SUMMARY OF THE DISCLOSURE

In satisfaction of the aforementioned needs, a retractable stop and the method of use thereof to control travel range of an elevator system are disclosed. The retractable stop may include a vertical mounting bracket, an impact plate, and a support member. The support member may include an upper end pivotably connected to the distal portion of the impact plate and a lower end movable in relation to the mounting bracket.

In another aspect of this disclosure, a method of using the disclosed retractable stop to control travel range of an elevator assembly comprising an elevator counterweight having a vertical trajectory is disclosed. The method may include the steps of providing a retractable stop, the stop comprising an impact plate and a support member having an upper end pivotably connected to the impact plate; and extending the stop into a deployed position in which the impact plate is at least substantially horizontal and within the vertical trajectory of the counterweight and in which the support member is at least substantially vertical.

Other advantages and features of the disclosed retractable stop and method of use thereof will be described in greater detail below. It will also be noted here and elsewhere that the device or method disclosed herein may be suitably modified to be used in a wide variety of applications by one of ordinary skill in the art without undue experimentation.

BRIEF DESCRIPTION OF THE DRAWINGS

For a more complete understanding of the disclosed device and method, reference should be made to the embodiments illustrated in greater detail in the accompanying drawings, wherein.

It should be understood that the drawings are not necessarily to scale and that the disclosed embodiments are sometimes illustrated diagrammatically and in partial views. In certain instances, details which are not necessary for an understanding of the disclosed device or method which render other details difficult to perceive may have been omitted. It should be understood, of course, that this disclosure is not limited to the particular embodiments illustrated herein.

DETAILED DESCRIPTION OF THE DISCLOSURE

This disclosure is generally directed to a safety device that maintains a desired amount of overhead clearance for a service technician operating on top of an elevator car in a hoistway. In particular, the device is a retractable stop that prevents further downward movement of a counterweight when deployed, thereby ensuring that the corresponding elevator car will not move above a selected height within the hoistway. As the device is generally mounted on a stationary vertical surface (e.g. a car guide) of an elevator system, "proximal" is used in this disclosure to refer to a direction toward the vertical surface while "distal" is used to refer to a direction away from the vertical surface.

Figure 1:
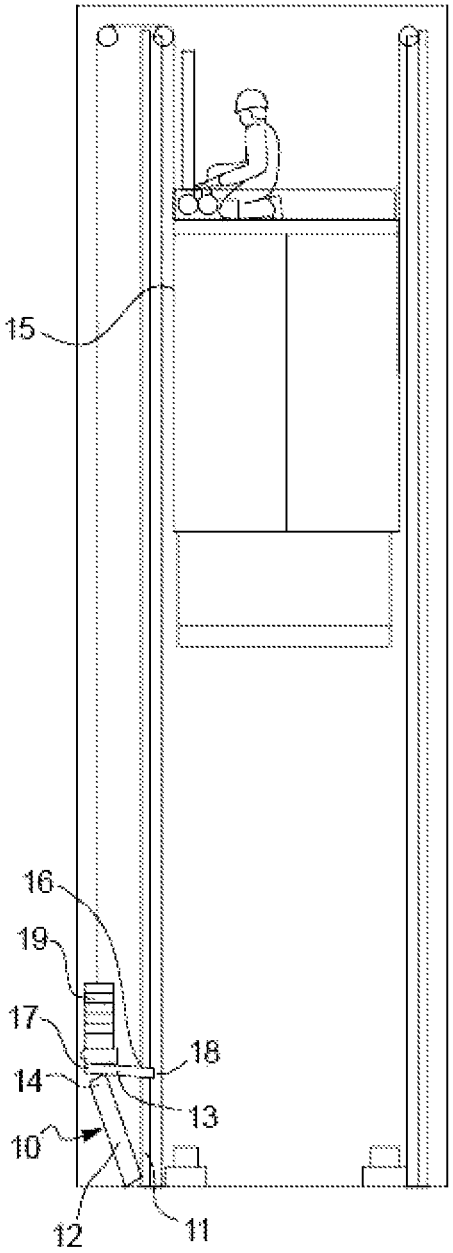
FIG. 1 (Prior Art)
FIG. 1 is a schematic illustration of a prior art elevator system using an existing retractable stop, depicted in a deployed position.
Figure 2:
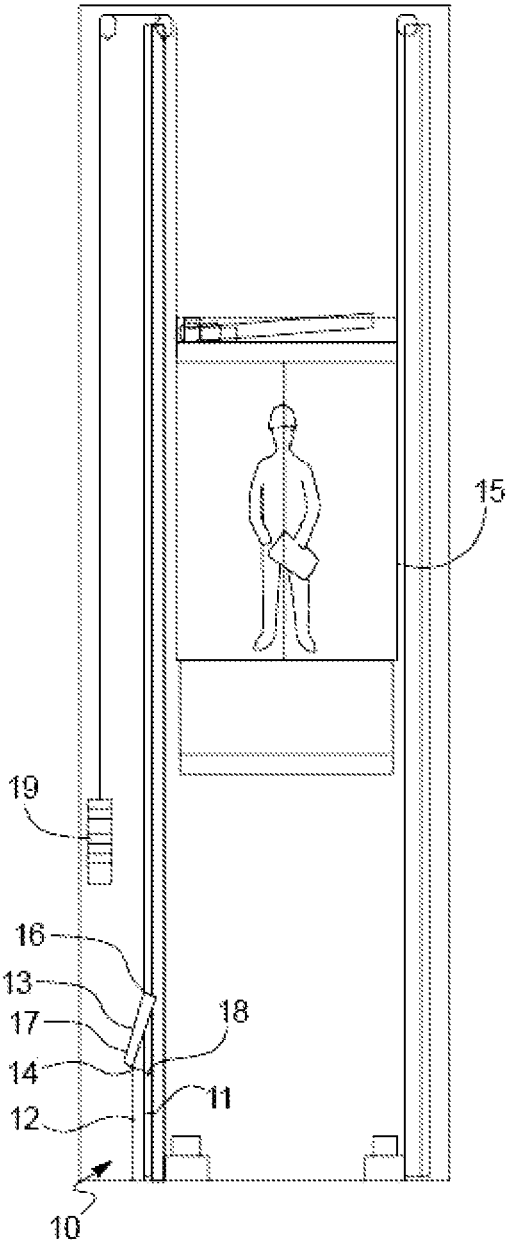
FIG. 2 (Prior Art)
FIG. 2 is a schematic illustration of the prior art elevator system with the retractable stop, depicted in a retracted position.
Figure 3:
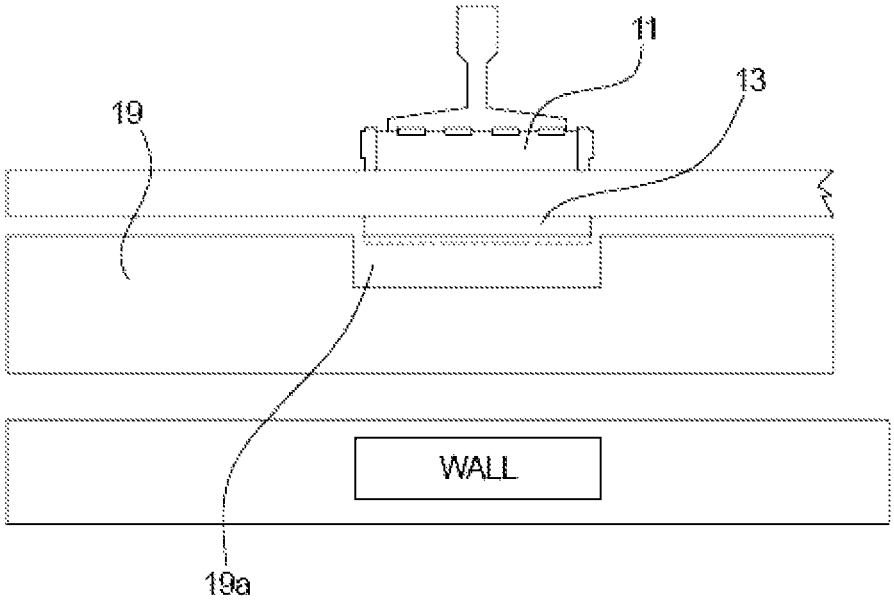
FIG. 3 (Prior Art)
FIG. 3 is a partial top view of the prior art elevator system in FIG. 2, particularly illustrating the lateral profile of the stop necessitating a surface groove on the counterweight to meet the minimum clearance requirement.

A prior art retractable stop with a triangular configuration is schematically illustrated in FIGS. 1-3. The triangular stop 10 includes a mounting channel 11 mounted on a car guide, a stop member 12 having a lower end pivotably connected to a lower end of the mounting channel 11, and a strike plate 13 having a proximal portion 16 slidably coupled to the car guide and a distal portion 17 pivotably connected to an upper end 14 of the stop member 12.

In a deployed position as illustrated in FIG. 1, the stop member 12 pivots away from the mounting channel 11, causing the distal portion 17 of the strike plate 13 to slide downwardly along the car guide until it rests on an upper end 18 of the mounting channel 11, forming a triangular support structure that blocks the vertical trajectory of a counterweight 19. Because the counterweight 19 is operatively connected to an elevator car 15, blocking downward movement of the counterweight 19 stops upward movement of the elevator car 15.

In a retracted position as illustrated in FIG. 2, the stop member 12 pivots toward the mounting channel 11, causing the proximal portion 16 of the strike plate 13 to slide upwardly along the car guide until the stop member 12 is in a substantially vertical position. In the retracted position, the stop 10 is clear of the vertical trajectory of the counterweight 19, thereby allowing movement of the elevator car 15 in its full range.

However, because of the lateral vector inherent to the triangular stop 10, the stop member 12 needs to be of a sufficient thickness and rigidity to sustain the impact force of the counterweight 19 when the stop 10 is deployed. Moreover, because of the sliding engagement of the strike plate 13 with the car guide, the strike plate 13 cannot be folded into a substantially or completely vertical position when the stop is retracted, which, in combination with the thickness of the stop member, may result in a lateral profile that cannot meet the minimum clearance requirement (e.g. 25 mm) between the stop and a conventional counterweight, as discussed earlier in this disclosure. One solution is to modify the counterweight 19 to include a vertical groove 19*a* as illustrated in FIG. 3, which may be economically undesirable and/or technologically challenging.

To address the aforementioned problem, the retractable stop disclosed herein has an improved lateral profile that meets the minimum clearance requirement without sacrificing its structural rigidity. In the embodiment disclosed in FIGS. 4-9, the disclosed stop 20 may include a mounting bracket 21 adapted to be secured to a stationary surface within the hoistway 27 of an elevator system. In this embodiment (as shown in particular in FIG. 6), the mounting bracket 21 is secured to a car guide 22 (which guides vertical movement of the elevator car) by a plurality of fasteners 23. However, the mounting bracket 21 may also be secured to a counterweight guide, a hoistway wall, a pit floor, or other suitable surfaces so long as the location of the stop 20 allows it to block the vertical trajectory of the counterweight when the stop 20 is deployed. The mounting bracket 21 may include upper and lower portions (24, 25). The lower portion 25 of the mounting bracket 21 may be indirectly coupled to a pit floor 26 of the hoistway 27 through a support plate (not shown) to reduce or prevent impact damage to the pit floor 26, or it may be in direct contact with the pit floor 26 if such damage is minimal or can be reduced by other designs.

The disclosed stop 20 may further include an impact plate 30 having proximal and distal portions (31, 32). The proximal portion 31 of the impact plate 30 may be pivotably connected to the upper portion 24 of the mounting bracket 21, such as through two rivets (33, 34) or the like. In an alternative embodiment (not shown), the proximal portion 31 of the impact plate 30 may also be slidably coupled to the car guide 22 (e.g. the configuration disclosed in WO 2008/002300). In any event, the impact plate 30 is pivotable from a retracted position (FIGS. 8-9) in which the impact plate 30 is at least substantially vertical, to a deployed position (FIGS. 6-7) in which the impact plate 30 is at least substantially horizontal. The dimension and shape of the impact plate 30 should allow the distal portion 32 of the impact plate 30 to at least partially protrude into the vertical trajectory of the counterweight when the stop 20 is deployed, and is not limited to the specific embodiment shown in FIGS. 4-9. In this disclosure, "substantially vertical" or "substantially horizontal" refers to an orientation that is within 10°, 5°, or even 3° of the vertical or horizontal orientation.

As another load-bearing component, the stop 20 may include a support member 40 having upper and lower ends (41, 42). The upper end 41 of the support member 40 is pivotably connected to the distal portion 32 of the impact plate 30, such as through two rivets (43, 44) or the like. Unlike the prior art triangular stop 10 illustrated in FIGS. 1-2, the lower end 42 of the support member 40 may be translationally movable in relation to the mounting bracket 21. In particular, the lower end 42 is horizontally extendable as the support member 40 moves from a retracted position (FIGS. 8-9), in which the support member 40 is closer to (or in this embodiment partially recessed within) the mounting bracket 21, to a deployed position (FIGS. 6-7), in which the support member 40 distally extends away from the mounting bracket 21. The support member 40, however, remains at least substantially vertical in both positions. Like the lower portion of the mounting bracket 21, the lower end 42 of the support member 40 in the deployed position may be indirectly coupled to the pit floor 26 of the hoistway 27 through a support plate (not shown) to reduce or prevent impact damage to the pit floor 26, or it may be in direct contact with the pit floor 26 if such damage is minimal or can be reduced by other designs. The support plates for the support member 40 and mounting bracket 21 may be a one-piece or separated design.

Figure 4:
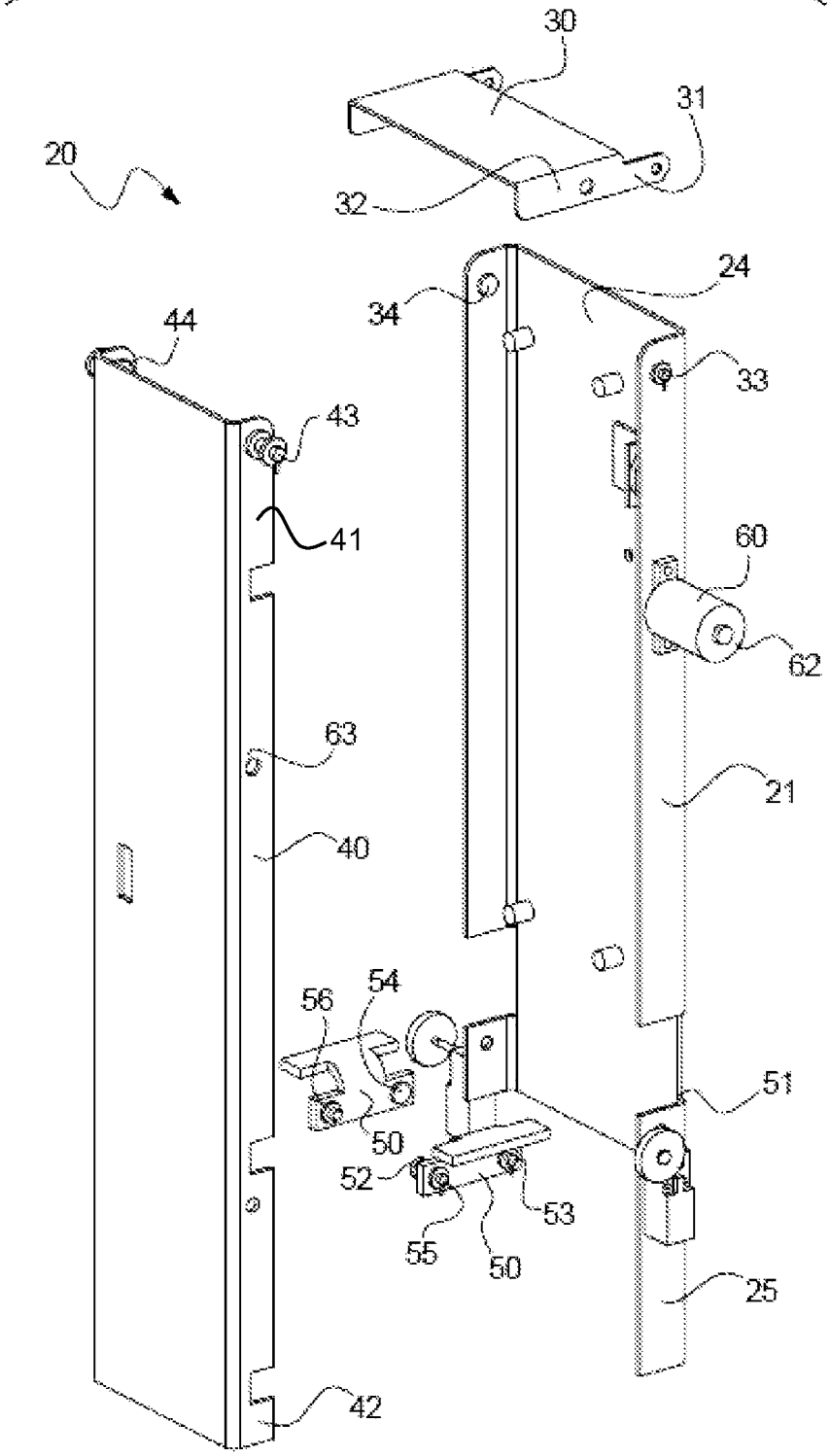
FIG. 4 is a front exploded view of one embodiment of a stop constructed in accordance with this disclosure.
Figure 5:
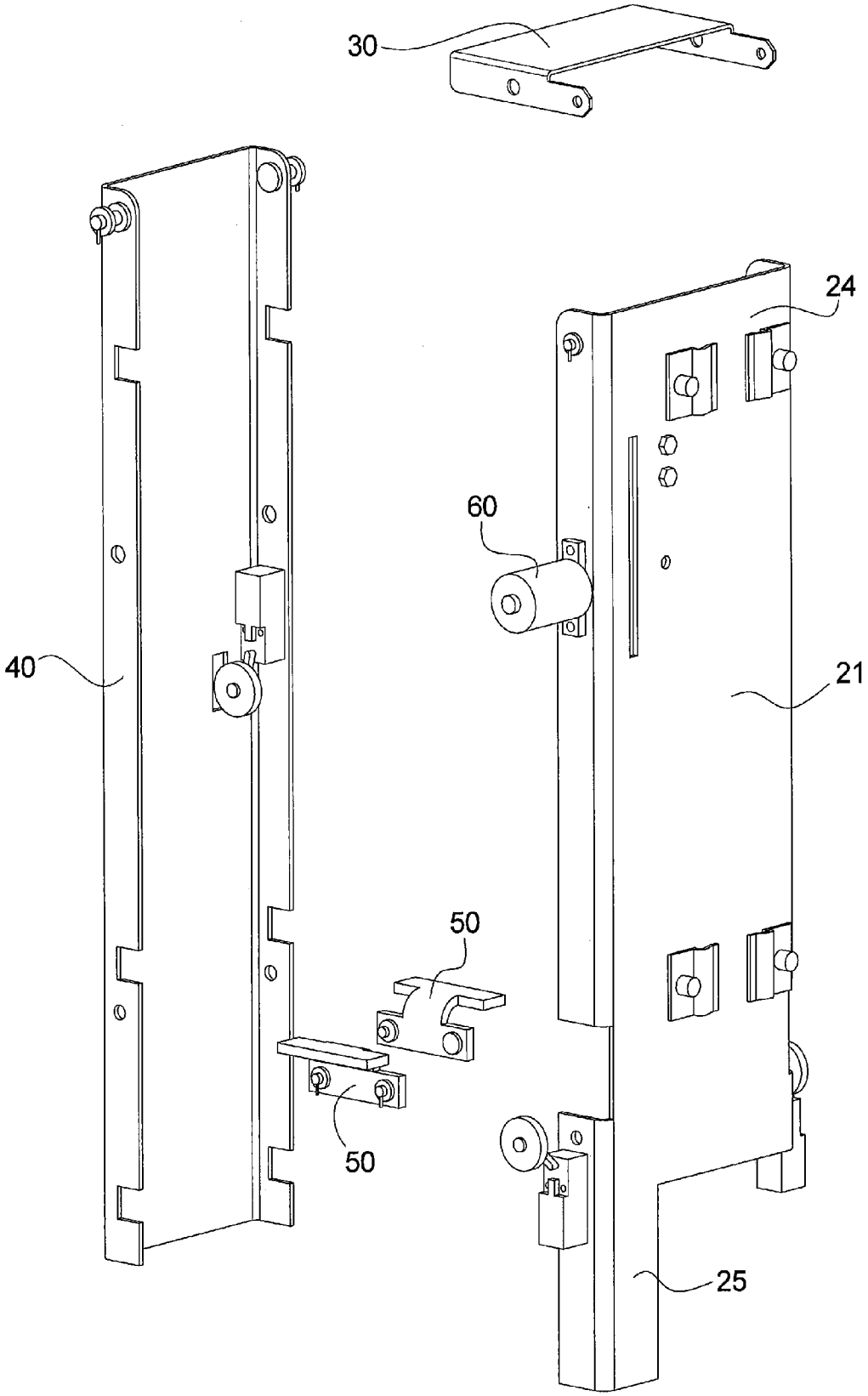
FIG. 5 is a back exploded view of the stop illustrated in FIG. 4.

Finally, the disclosed stop 20 may further include an optional cross member 50 that interconnects the mounting bracket 21 and support member 40 for structural rigidity purposes. The cross member 50 may also assist the movement of the support member 40 between the retracted and deployed positions. As illustrated in FIGS. 4-5, the cross member 50 may also include proximal and distal portions (51, 52). The proximal portion 51 of the cross member 50 is pivotably connected to the mounting bracket 21 through rivets (53, 54) or the like, while the distal portion 52 may be pivotably connected to the support member 40 through rivets (55, 56) or the like. The cross member 50 may be of a single-piece construction or it may include two side bars as shown in FIGS. 4-5. Besides improving structural rigidity of the disclosed stop 20, the cross member 50 may also facilitate the transition of the stop 20 between the deployed and retracted positions, which is discussed in greater detail below.

Figure 6:
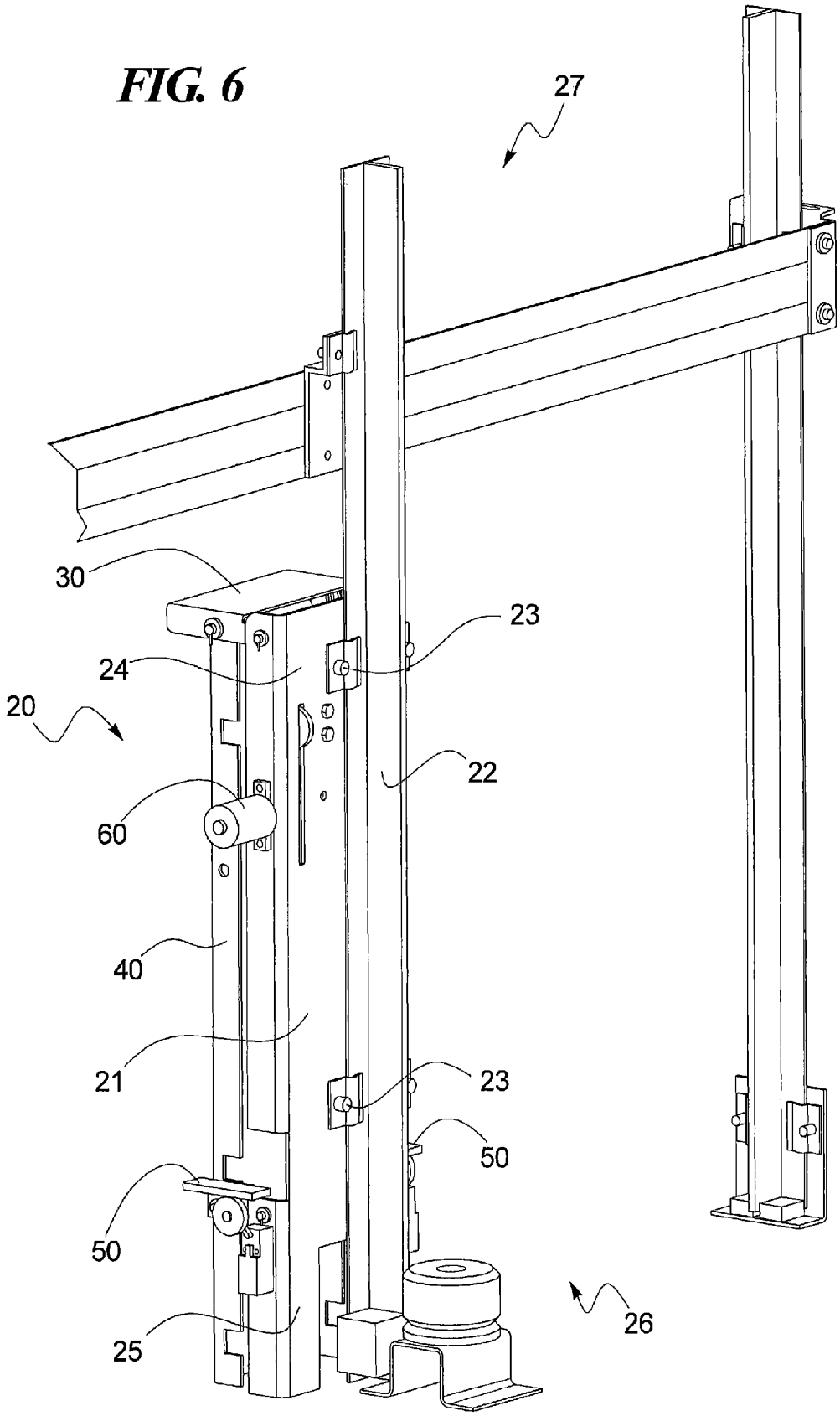
FIG. 6 is a back perspective view of the stop shown in FIGS. 4-5 and depicted in a deployed position.
Figure 7:
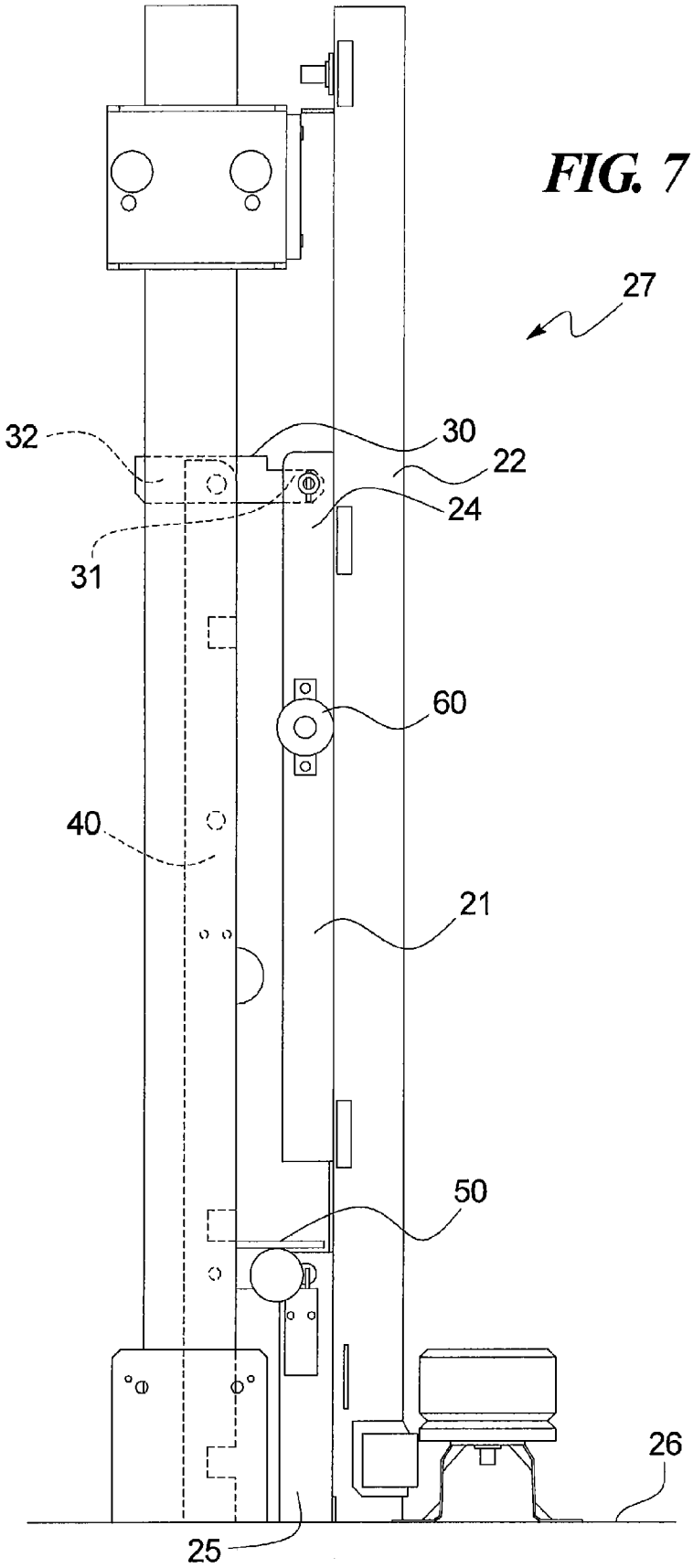
FIG. 7 is a side view of the stop illustrated in FIG. 6.
Figure 8:
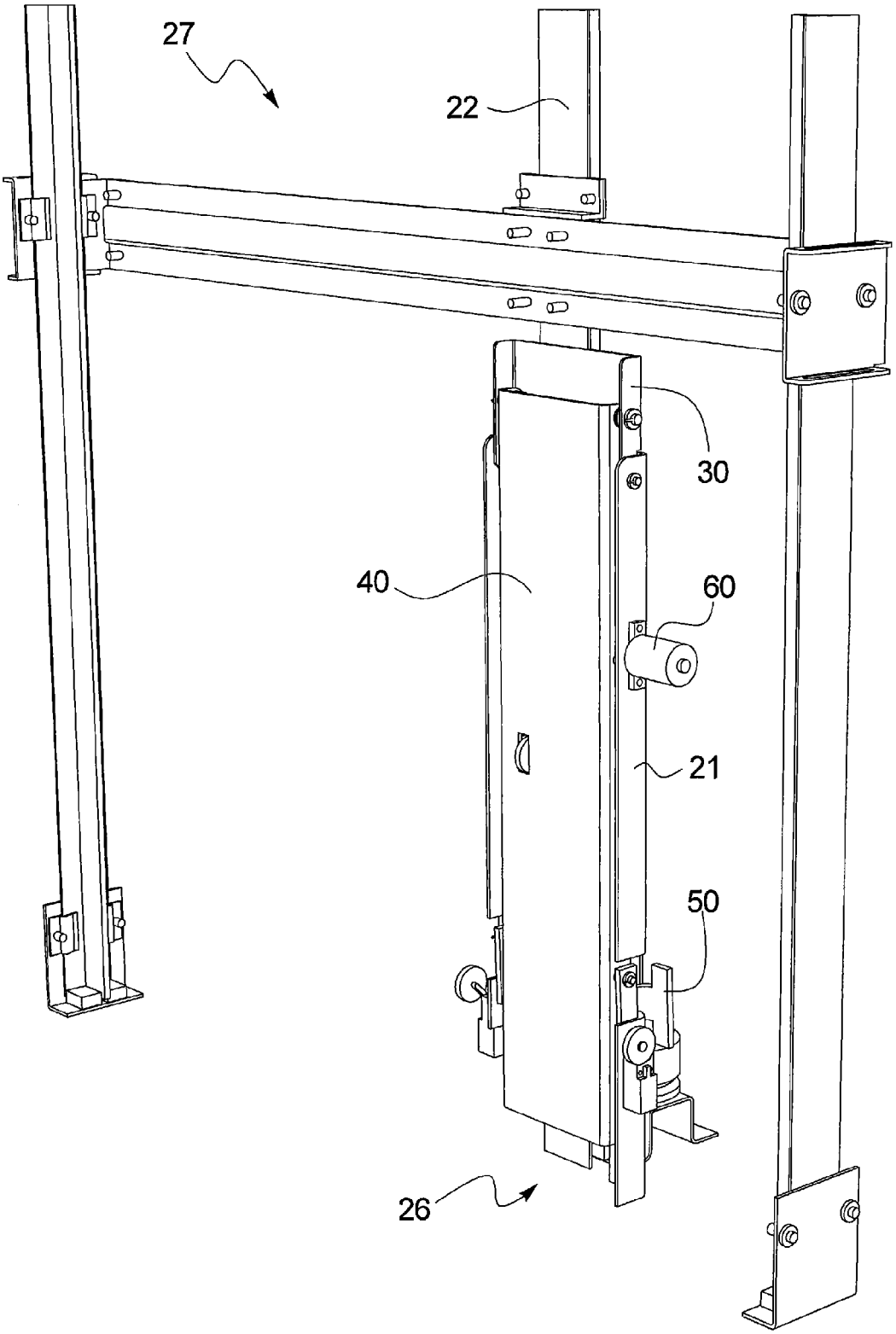
FIG. 8 is an front perspective view of the stop illustrated in FIGS. 4-5 and depicted in a retracted position.
Figure 9:
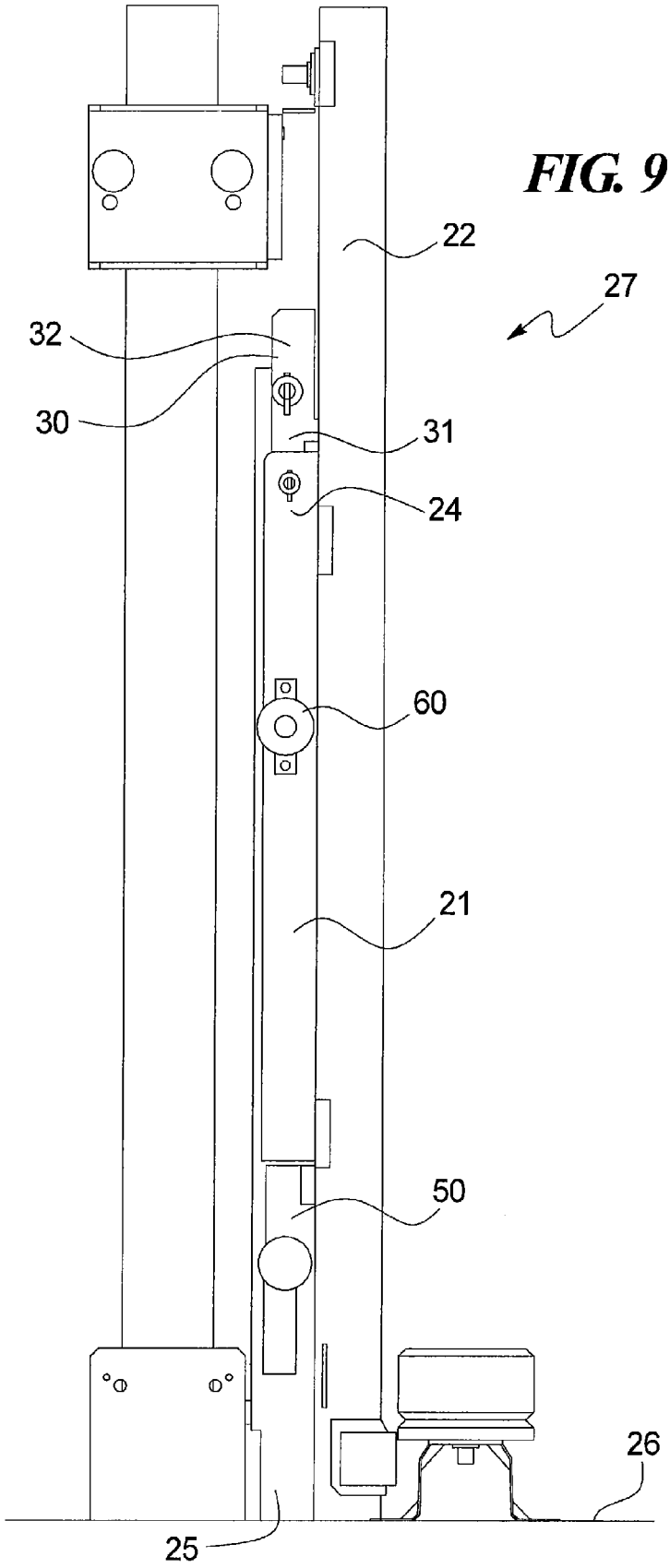
FIG. 9 is an side view of the stop illustrated in FIG. 8.

When the stop 20 is deployed as illustrated in FIGS. 6-7, the cross member 50 is pivoted away from the mounting bracket 21 until it is in an at least substantially horizontal position, thereby extending the support member 40 distally away from the mounting bracket 21. To retract the stop 20, the cross member 50 is pivoted toward the mounting bracket 21 until it is in an at least substantially vertical position as illustrated in FIGS. 8-9, thereby moving the support member 40 proximally toward the mounting bracket 21. However, the stop 20 may also be deployed and/or retracted without the assistance of the cross member 50, such as by simply pushing or pulling the support member 40 or pivoting the impact plate 30.

Figure 10:
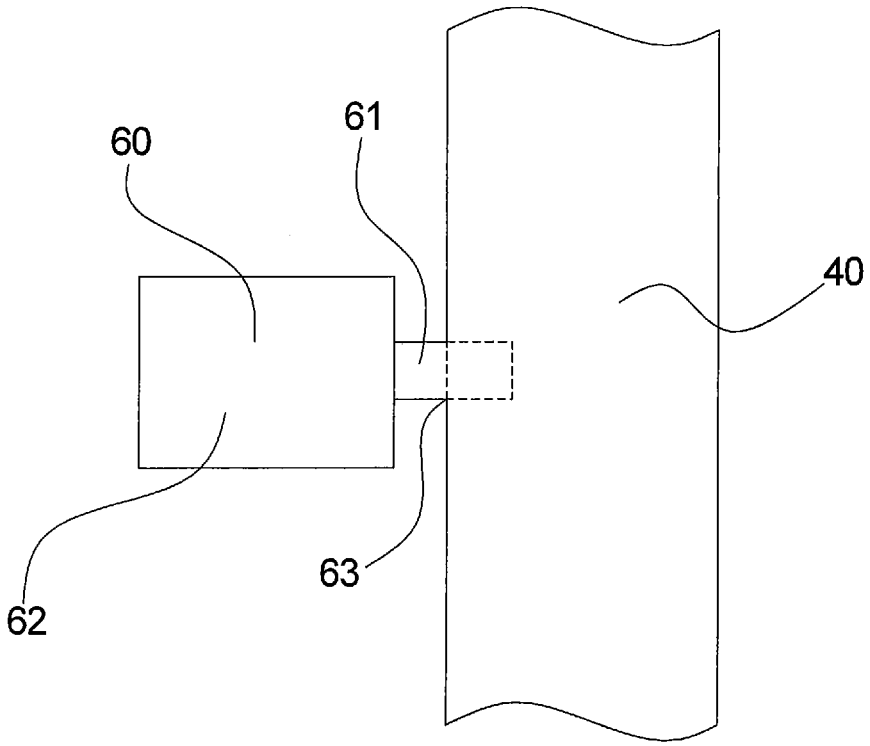
FIG. 10 is a partial top view of the stop illustrated in FIGS. 4-9, particularly illustrating the retractable locking pin.

As illustrated in FIGS. 4-9, the mounting bracket 21 may further include an optional holding member 60 that releasably couples the mounting bracket 21 and support member 40 together when the stop 20 is in the retracted position. Turning to FIG. 10, the holding member 60 may include a retractable locking pin 61 operatively coupled to an actuator 62, such as a solenoid coil that controls the position of the pin 61. When the stop 20 is in the retracted position, the pin 61 protrudes into at least one receiving area 63 provided on the support member 40, thereby holding the support member 40 close to the mounting bracket 21. To deploy the stop 20, the pin 61 is retracted by the actuator 62, thereby releasing the support member 40 from the mounting bracket 21. Although the receiving area 63 is shown in FIGS. 4-5 as a side opening, it may alternatively be a recess provided on the surface of the support member 40. Likewise, the locations of the holding member 60 and receiving area 63 are not limited to the embodiments disclosed herein. Finally, instead of being electronically actuated by the solenoid coil, the retractable pin 61 may be mechanically actuated, such as through hydraulic actuators, or even manually actuated.

Figure 11:
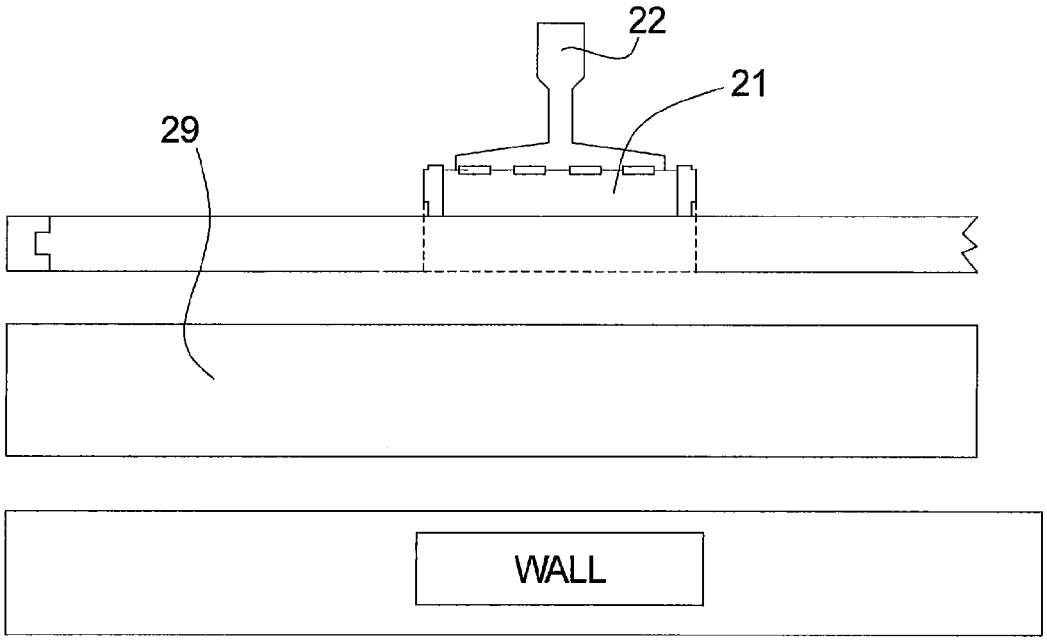
FIG. 11 is a partial top view of an elevator system using the stop illustrated in FIGS. 8-9, particularly illustrating the improved lateral profile of the disclosed stop and depicted in the retracted position.

One feature of the disclosed stop 20 is that the vertical orientation of the support member 40, in contrast to the oblique orientation in the prior art triangular stop 10, at least substantially reduces or eliminates the horizontal vector of the impact force caused by the counterweight when the stop 20 is deployed. As a result, the overall lateral profile of the support member 40 and the stop 20 may be reduced while maintaining the required structural rigidity. Another optional feature of the disclosed stop 20 is that the proximal portion 31 of the impact plate 30 is pivotably connected to the mounting bracket 21, which allows the impact plate 30 to be at least substantially vertical when the stop 20 is retracted, thereby reducing or even eliminating its contribution to the overall lateral profile of the stop 20. As illustrated in FIG. 11, the disclosed stop 20 with a reduced lateral profile meets the minimum clearance requirement (e.g. 25 mm) without any modification (e.g. vertical surface grooves) to the counterweight 29.

In some embodiments, the stop 20 may further include an indicator (not shown) that signals the current position of the stop 20 to a service technician. The indicator may be visual (e.g. green and red lights positioned on the elevator roof to indicate the deployed and retracted positions of the stop, respectively) and/or audio (e.g. a series of beeps). Alternatively, the indicator may be electronic and include a transmitter than sends signals to a receiver that is accessible to the service technician.

For example, the receiver may be integrated into a control panel positioned on top of the elevator car. The control panel may further include at least one switch that remotely controls the operation of the stop 20, such as by remotely manipulating the actuator 62 to release the stop 20 from the retracted position to the deployed position. The control panel may also include a module that controls the movement of the elevator car running under maintenance mode. In light of this disclosure, those skilled in the art would be able to select from among known components and to arrange wire-based or wireless communications between the stop 20 and the service technician to achieve the desired control of the position of the stop 20 between the normal and maintenance operation modes of the elevator car.

Figure 12:
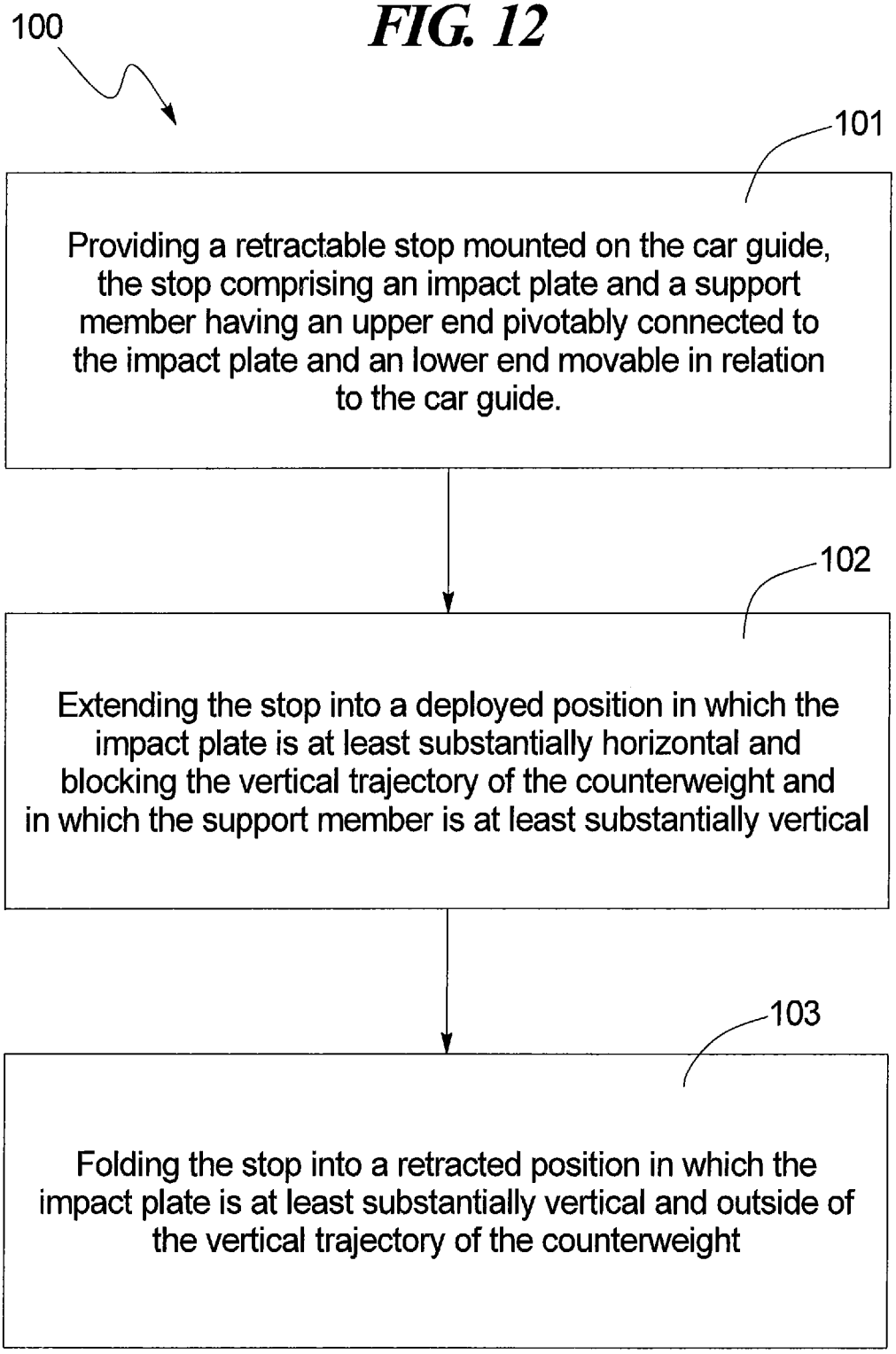
FIG. 12 is a block diagram of a method of controlling travel range of an elevator assembly according to another aspect of this disclosure.

In another aspect of this disclosure illustrated in FIG. 12, a method of controlling travel range of an elevator counterweight having a vertical trajectory is disclosed. The method 100 may include the steps of: providing a retractable stop, the stop comprising an impact plate and a support member having an upper end pivotably connected to the impact plate and a lower end movable in relation to the car guide (101); extending the stop into a deployed position in which the support member remains at least substantially vertical while the impact plate is at least substantially horizontal and at least partially blocking the vertical trajectory of the counterweight (102); and folding the stop into a retracted position in which the impact plate is at least substantially vertical and outside of the vertical trajectory of the counterweight (103).

The retractable stop disclosed herein may have a wide range of industrial, commercial or household applications. The stop may be employed with new elevator installations or conveniently installed in existing elevator systems without significant modifications thereto. Moreover, the disclosed stop meets the minimum clearance standard by achieving a smaller overall lateral profile without sacrificing durability or structural rigidity.

While only certain embodiments have been set forth, alternative embodiments and various modifications will be apparent from the above descriptions to those skilled in the art. These and other alternatives are considered equivalents and within the spirit and scope of this disclosure.

What is claimed is:

1. An elevator retractable stop retractable from a deployed position to a retracted position comprising:

a mounting bracket mounted in a vertical orientation, the vertical orientation corresponding to a direction of motion of a counterweight, the mounting bracket having upper and lower portions;

an impact plate having proximal and distal portions, the proximal portion of the impact plate being pivotably connected to the mounting bracket; and a support member having an upper end pivotably connected to the distal portion of the impact plate and a lower end movable in relation to the mounting bracket;

wherein the proximal portion of the impact plate is pivotably connected to the upper portion of the mounting bracket, and the impact plate is horizontal in the deployed position to block downward movement of the counterweight and is vertical in the retracted position, wherein horizontal is perpendicular to vertical; and wherein the support member remains vertical both in the deployed position and the retracted position.

2. The retractable stop of claim 1, further comprising a cross member having a proximal end pivotably connected to the mounting bracket and a distal end pivotably connected to the support member.

3. The retractable stop of claim 2, wherein the cross member is horizontal in the deployed position.

4. The retractable stop of claim 2, wherein the cross member is vertical in the retracted position.

5. The retractable stop of claim 1, wherein the mounting bracket is secured to a car guide of an elevator assembly.

6. The retractable stop of claim 5, wherein the mounting bracket is in direct contact with a pit floor of the elevator assembly.

7. The retractable stop of claim 5, wherein a vertical trajectory of the counterweight is blocked by the impact plate when the stop is in the deployed position.

8. The retractable stop of claim 5, wherein a vertical trajectory of the counterweight is not blocked by the impact plate when the retractable stop is in the retracted position.

9. The retractable stop of claim 1, wherein the mounting bracket comprises a holding member that releasably couples the mounting bracket and support member together when the stop is in the retracted position.

10. The retractable stop of claim 9, wherein the holding member comprises a retractable locking pin capable of protruding into a receiving area on the support member when the stop is in the retracted position.

11. The retractable stop of claim 10, wherein the locking pin is actuated by a solenoid.

* * * * *